US009484166B1

(12) United States Patent
Pierce

(10) Patent No.: US 9,484,166 B1
(45) **Date of Patent: *Nov. 1, 2016**

(54) DOUBLE-THROW SWITCH WITH POSITIVE STOPS FOR PREVENTING MOVEMENT OF THE STATIONARY CONTACTS

(71) Applicant: E.M.B. Corporation, Elizabethtown, KY (US)

(72) Inventor: Anthony E. Pierce, Elizabethtown, KY (US)

(73) Assignee: E.M.B. Corporation, Elizabethtown, KY (US)

( * ) Notice: Subject to any disclaimer, the term of this patent is extended or adjusted under 35 U.S.C. 154(b) by 25 days.

This patent is subject to a terminal disclaimer.

(21) Appl. No.: 14/631,226

(22) Filed: Feb. 25, 2015

Related U.S. Application Data

(60) Provisional application No. 61/948,992, filed on Mar. 6, 2014.

(51) Int. Cl.
*H01H 1/26* (2006.01)
*H01H 13/52* (2006.01)

(52) U.S. Cl.
CPC ..... *H01H 13/52* (2013.01)

(58) Field of Classification Search
CPC ..... H01H 1/26; H01H 1/30; H01H 1/34; H01H 3/12; H01H 3/52; H01H 5/18; H01H 13/36; H01H 11/0012; H01H 2001/265; H01H 2001/247
USPC ..... 200/271, 245, 246, 247, 535, 283, 6 C
See application file for complete search history.

(56) References Cited

U.S. PATENT DOCUMENTS 3,809,834 A * 5/1974 Hipple ..... H01H 13/36 200/452
4,902,863 A * 2/1990 Fukuma ..... H01H 13/28 200/445
9,218,926 B1 * 12/2015 Pierce ..... H01H 1/26
2014/0042006 A1 * 2/2014 Lin ..... H01H 13/42 200/535

OTHER PUBLICATIONS

U.S. Appl. No. 14/185,625, filed Feb. 20, 2014.
U.S. Appl. No. 14/631,123, filed Feb. 25, 2015.

* cited by examiner

*Primary Examiner* — Vanessa Girardi
(74) *Attorney, Agent, or Firm* — Stites & Harbison, PLLC; David W. Nagle, Jr.; James R. Hayne

(57) ABSTRACT

A double-throw switch comprises: a housing; a push button that is mounted for movement with respect to the housing; a first stationary terminal; a second stationary terminal; a moveable terminal that, when in contact with the first stationary terminal, closes a first circuit, and when in contact with the second stationary terminal, closes a second circuit; a first set of one or more positive stops that engage the first stationary terminal; and a second set of one or more positive stops that engage the second stationary terminal. The first set of one or more positive stops applies pressure to and maintains a predetermined position of the first stationary terminal. The second set of one or more positive stops applies pressure to and maintains a predetermined position of the second stationary terminal.

18 Claims, 8 Drawing Sheets

(BOTTOM VIEW)

(BOTTOM VIEW)

DOUBLE-THROW SWITCH WITH POSITIVE STOPS FOR PREVENTING MOVEMENT OF THE STATIONARY CONTACTS

CROSS-REFERENCES TO RELATED APPLICATIONS

The present application claims priority to U.S. Provisional Patent Application Ser. No. 61/948,992 filed on Mar. 6, 2014, the entire disclosure of which is incorporated herein by reference.

The present application also is directed to similar subject matter as commonly assigned U.S. patent application Ser. No. 14/185,625 filed on Feb. 20, 2014 (now U.S. Pat. No. 9,218,926), which itself claims priority to U.S. Provisional Patent Application Ser. No. 61/787,830 filed on Mar. 15, 2013, the entire disclosures of which are incorporated herein by this reference.

The present application also is directed to similar subject matter as commonly assigned and co-pending U.S. patent application Ser. No. 14/631,123 entitled "Normally-Open Switch with Positive Stops" and filed on the same date as the present application, which itself claims priority to U.S. Provisional Patent Application Ser. No. 61/949,017 filed on Mar. 6, 2014, the entire disclosures of which are incorporated herein by this reference.

BACKGROUND OF THE INVENTION

Many devices utilize a double-throw switch to alternate power between two separate circuits. In some cases, such switches have a push button that is biased into an extended position. When the push button is in this extended position, a moveable terminal is in contact with a first stationary terminal, closing a first circuit. At the same time, the moveable terminal is not in contact with a second stationary terminal, leaving a second circuit open. As a force is applied to the push button, the push button rotates into the housing of the switch. Such rotation of the push button causes an internal post member to move downward and apply pressure to a moveable terminal, causing the moveable terminal to break contact with the first stationary terminal and make contact with the second stationary terminal, thus opening the first circuit and closing the second circuit.

One problem that can occur with such a double-throw switch is that, in some cases, the moveable terminal does not disengage from one of the stationary terminals before making contact with the other stationary terminal. In other words, it has been observed that when the moveable terminal breaks contact with a stationary terminal, there is often some slight movement of the stationary terminal. In other words, a stationary terminal may move with the moveable terminal to some extent, resisting the disengagement of the moveable terminal from the stationary terminal.

Commonly assigned and co-pending U.S. patent application Ser. No. 14/185,625 describes a solution to this problem in the context of normally-closed switches. In U.S. patent application Ser. No. 14/185,625, which again is incorporated herein by reference, the normally-closed switch further includes one or more positive stops engaging the stationary terminal at a predetermined position in the movement of the stationary terminal. Thus, the stationary terminal is prevented, at a given point, from any further movement with the moveable terminal, at least beyond the predetermined position. In other words, the positive stops substantially eliminate any resistance to the disengagement of the moveable terminal from the stationary terminal. And, as a result, the normally-closed circuit opens and closes more consistently.

There remains a need for an improved construction for a double-throw switch that similarly ensures that the circuit opens and closes more consistently.

SUMMARY OF THE INVENTION

The present invention is a double-throw switch with positive stops.

A double-throw switch made in accordance with the present invention includes a housing that defines an internal cavity in which the internal components of the switch are housed. The switch further includes a push button that is mounted for movement with respect to the housing. When the push button is in an extended position, a moveable terminal is in contact with a first stationary terminal, leaving a first circuit closed, and the moveable terminal is not in contact with a second stationary terminal, leaving a second circuit open. However, when a force is applied to the push button, the push button rotates into the housing about a pivot axis. Such rotation of the push button forces an internal post member, which extends between the push button and the moveable terminal, to move downward. As it moves downward, the distal end of the internal post member engages and applies pressure to the moveable terminal, causing the moveable terminal to break contact with the first stationary terminal and then make contact with the second stationary terminal, thus opening the first circuit and closing the second circuit. Once the force is no longer applied to the push button, the push button returns to the extended position, and the moveable terminal breaks contact with the second stationary terminal and then again makes contact with the first stationary terminal. In this regard, the moveable terminal has sufficient resilience that it also functions like a leaf spring, providing a biasing force against the internal post member that returns the push button to the extended position.

The double-throw switch further includes a first set of one or more positive stops engaging the first stationary terminal at a predetermined position in the movement of the first stationary terminal. Thus, the first stationary terminal is prevented, at a given point, from any further movement with the moveable terminal, at least beyond the predetermined position. In other words, the first set of one or more positive stops substantially eliminates any resistance to the disengagement of the moveable terminal from the first stationary terminal.

The double-throw switch further includes a second set of one or more positive stops engaging the second stationary terminal at a predetermined position in the movement of the second stationary terminal. Thus, the second stationary terminal is prevented, at a given point, from any further movement with the moveable terminal, at least beyond the predetermined position. In other words, the second set of one or more positive stops substantially eliminates any resistance to the disengagement of the moveable terminal from the second stationary terminal.

As a result, the double-throw switch opens and closes the first and second circuits more consistently.

DETAILED DESCRIPTION OF THE INVENTION

The present invention is a double-throw switch with positive stops.

Figure 4:
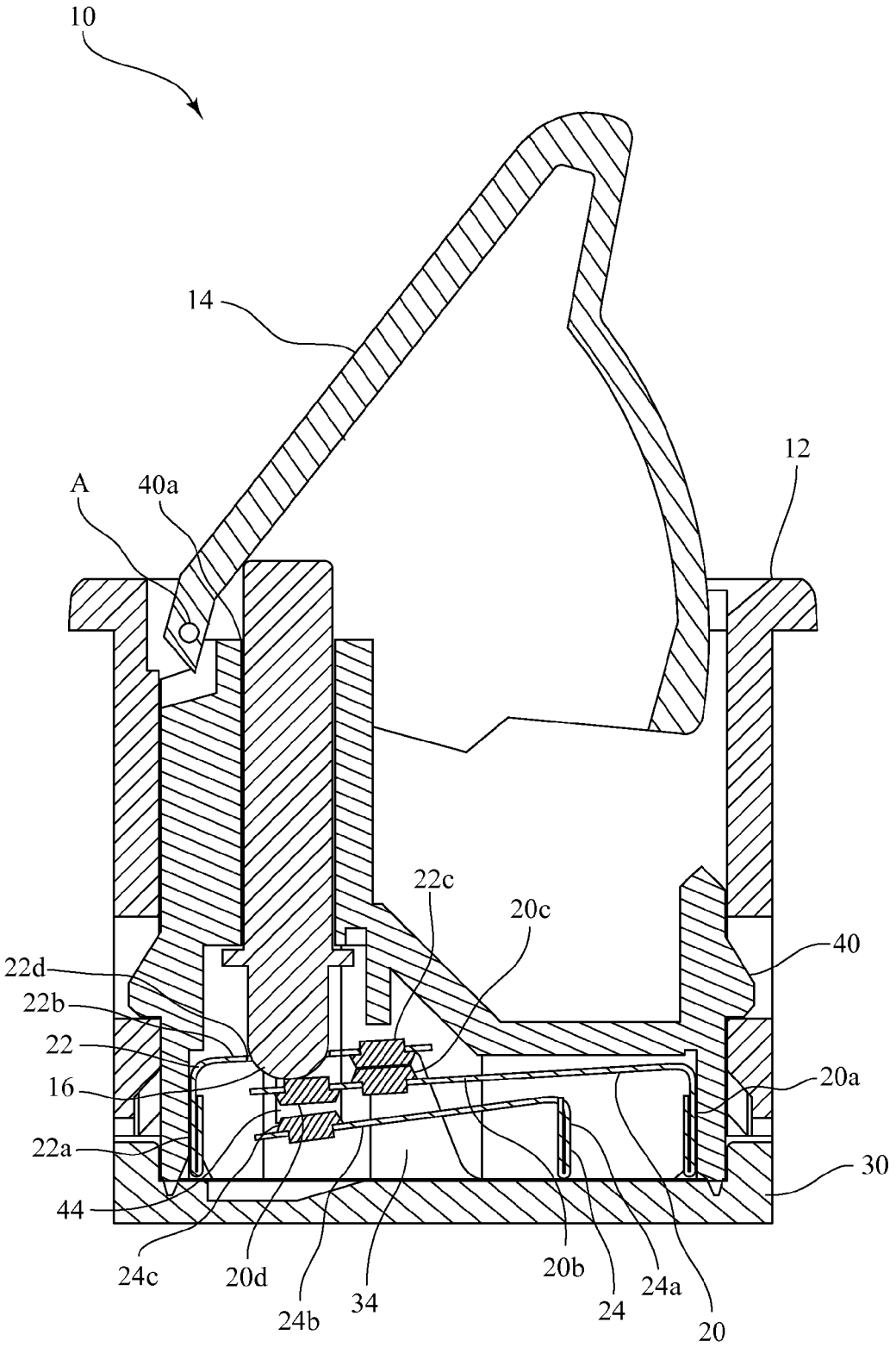
FIG. 4 is a side sectional view of the exemplary double-throw switch of FIG. 1, wherein the first circuit is in a closed position, and the second circuit is in an open position.

FIGS. 1-8 are various views of an exemplary double-throw switch 10 made in accordance with the present invention. As perhaps best shown in the sectional views of FIGS. 4 and 5, the exemplary double-throw switch 10 includes a housing 12 that defines an internal cavity in which the internal components of the switch 10 are housed. The exemplary double-throw switch 10 also includes a cover 30 that closes access to the internal cavity defined by the housing 12 of the switch 10 and a base 40 that is located within the internal cavity defined by the housing 12, the importance of which is further described below. As also best shown in the sectional views of FIGS. 4 and 5, the exemplary double-throw switch 10 further includes a push button 14 that is mounted for movement with respect to the housing 12. When the push button 14 is in an extended position (as shown in FIG. 4), a moveable terminal 20 is in contact with a first stationary terminal 22, leaving a first circuit closed, but the moveable terminal 20 is not in contact with a second stationary terminal 24, leaving a second circuit open. However, when a force is applied to the push button 14 (as indicated by arrow F in FIG. 5), the push button 14 rotates into the housing 12 about a pivot axis A. Such rotation of the push button 14 forces an internal post member 16, which extends between the push button 14 and the moveable terminal 20, to move downward. As the internal post member 16 moves downward, the distal end of the internal post member 16 engages and applies pressure to the moveable terminal 20, causing the moveable terminal 20 to break contact with the first stationary terminal 22 and then make contact with the second stationary terminal 24, thus opening the first circuit and closing the second circuit.

Figure 5:
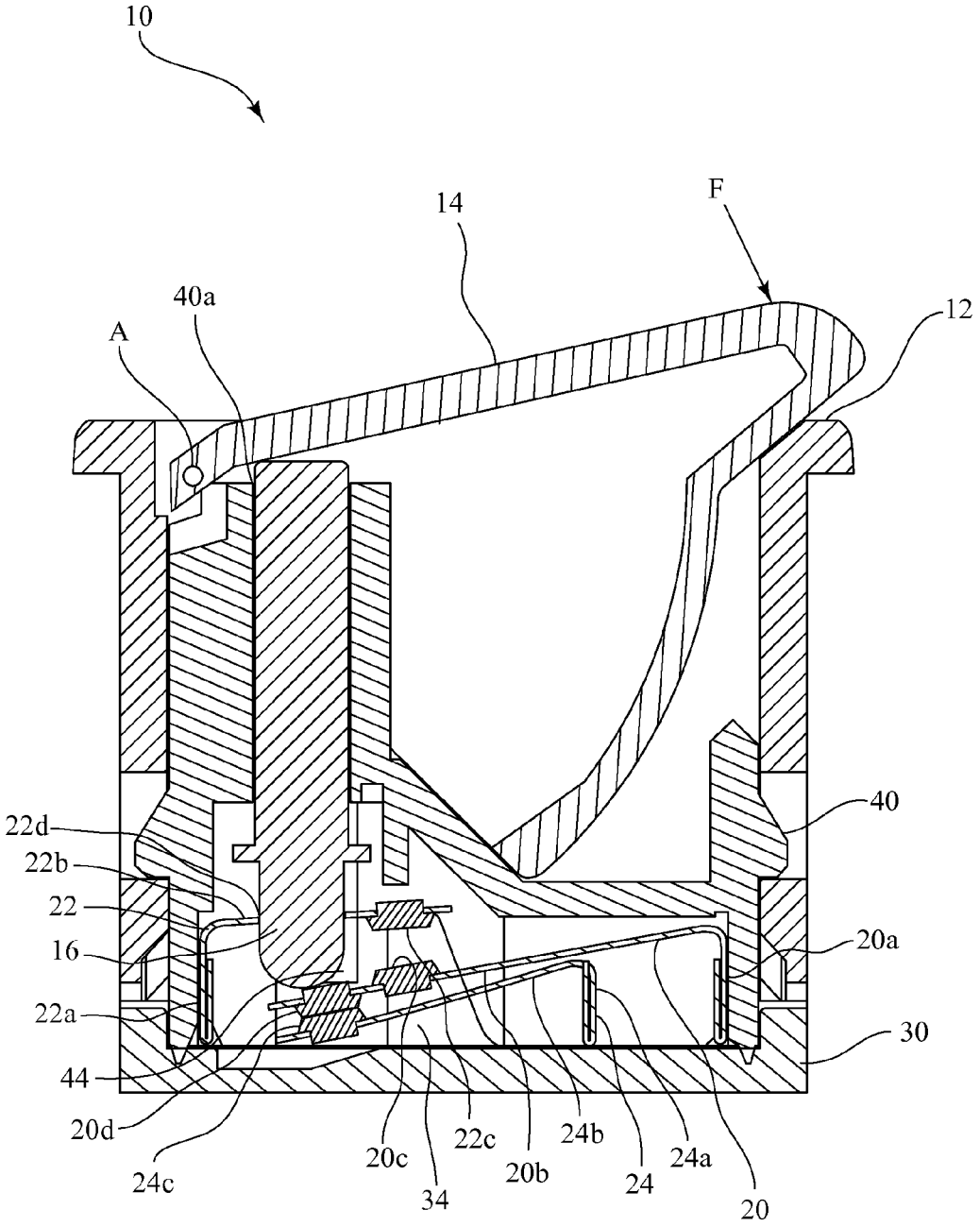
FIG. 5 is a side sectional view of the exemplary double-throw switch of FIG. 1, wherein the first circuit is in an open position and the second circuit is in a closed position.
Figure 6:
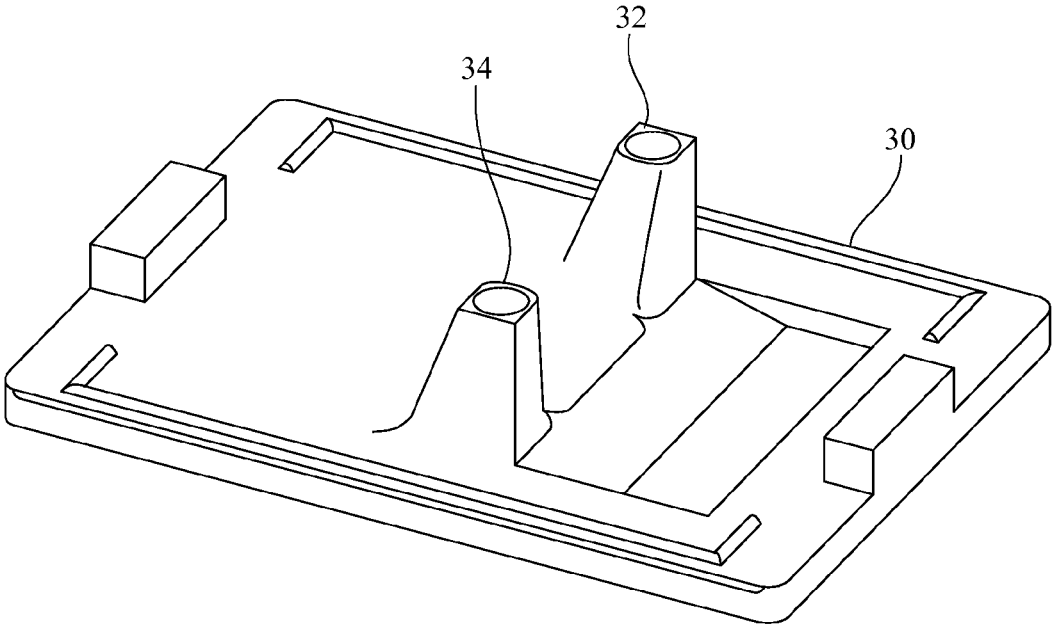
FIG. 6 is a perspective view of the cover of the exemplary double-throw switch of FIG. 1.

In this exemplary embodiment, the moveable terminal 20 is a unitary component made from a conductive material, such as copper. However, the moveable terminal 20 can be characterized as including a first portion 20*a* that is rigidly secured within the internal cavity defined by the housing 12 and serves as a blade connector, along with a second portion 20*b* that extends from the first portion 20*a* in a cantilever arrangement. In other words, the second portion 20*b* is effectively a cantilever that is anchored to the first portion 20*a*. When a sufficient force is applied to the distal end of the second portion 20*b* of the moveable terminal 20, it will deflect and rotate downward relative to the first portion 20*a* of the moveable terminal 20 about an axis defined by the interface between the first portion 20*a* and the second portion 20*b*. Finally, with respect to the moveable terminal 20, as best shown in FIGS. 4 and 5, the moveable terminal 20 includes an enlarged first contact portion 20*c* on the upper surface of the second portion 20*b* and an enlarged second contact portion 20*d* on the lower surface of the second portion 20*b*. As shown, in this exemplary embodiment, the second contact portion 20*d* is closer to the distal end of the second portion 20*b* of the moveable terminal 20 than the first contact portion 20*c*.

Figure 1:
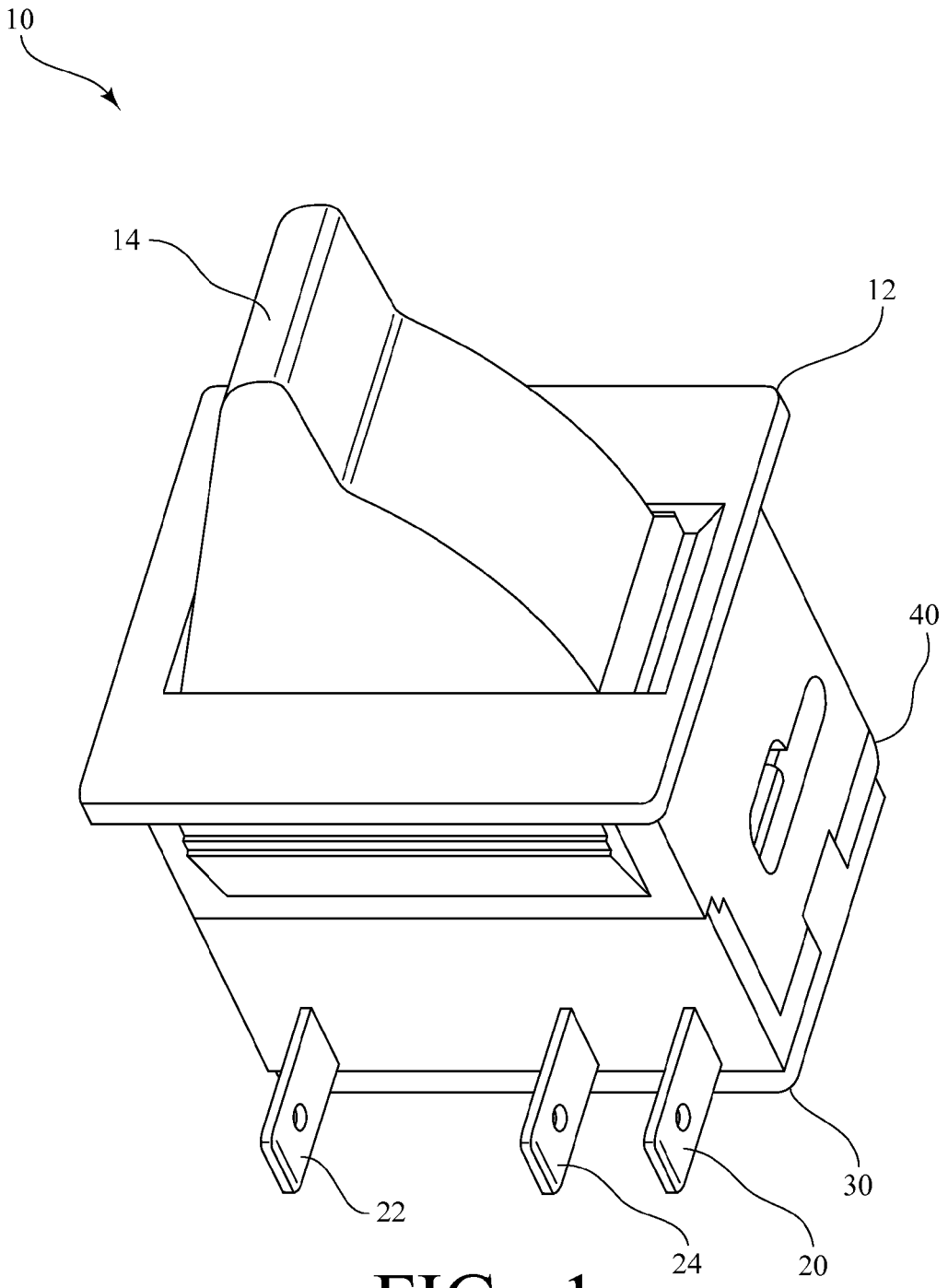
FIG. 1 is a perspective view of an exemplary double-throw switch made in accordance with the present invention.
Figure 2:
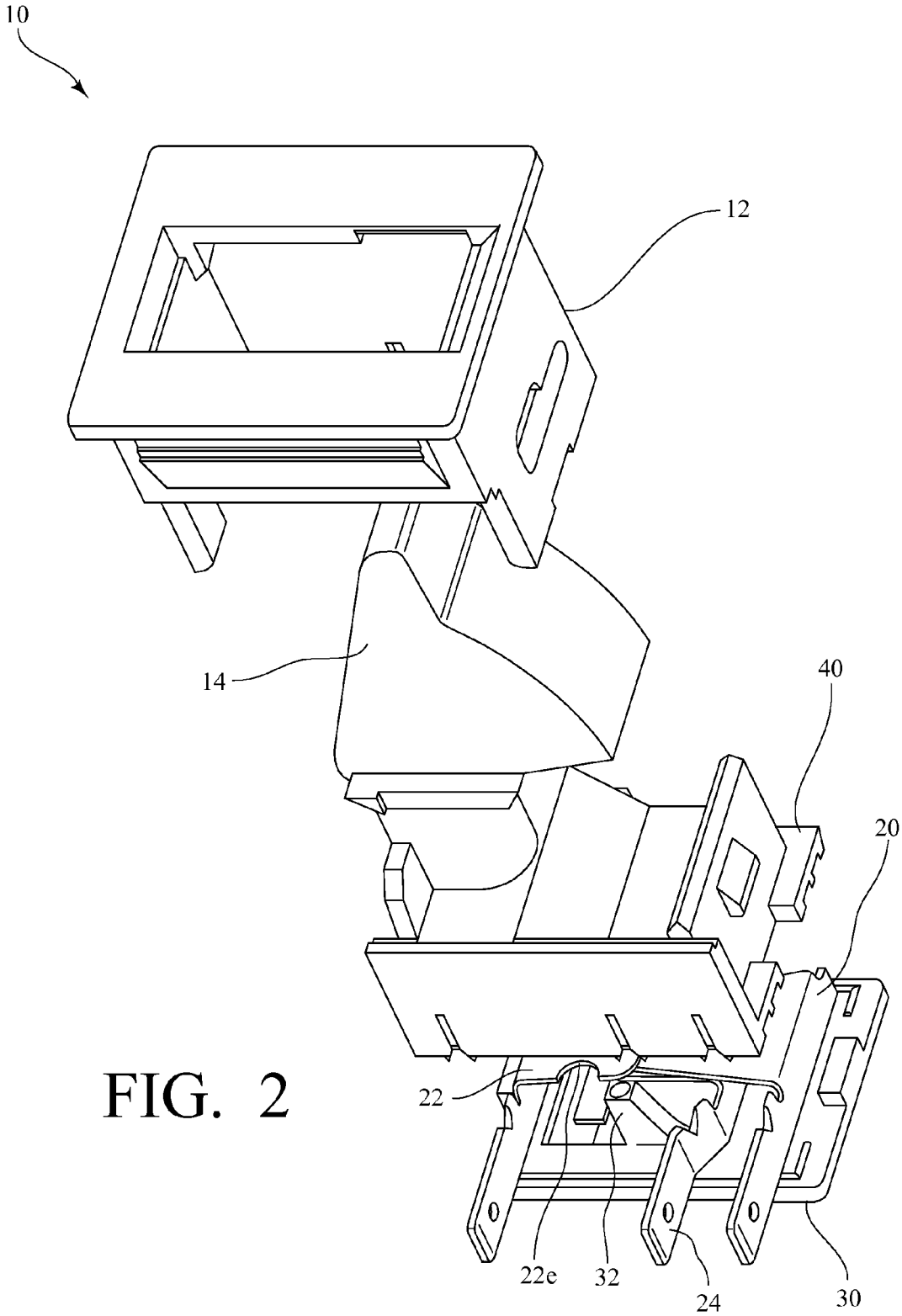
FIG. 2 is an exploded perspective view of the exemplary double-throw switch of FIG. 1.
Figure 3:
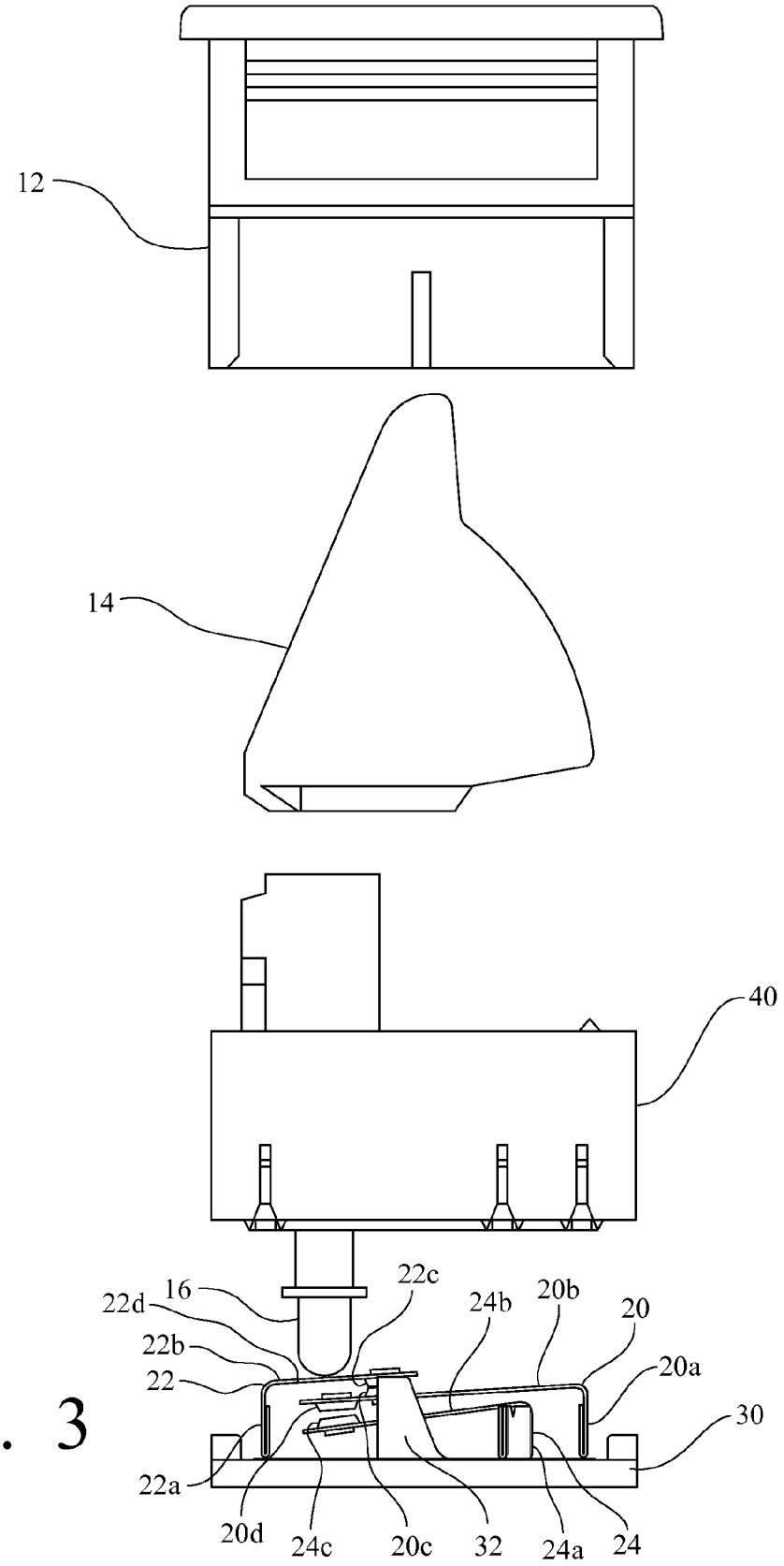
FIG. 3 is an exploded side view of the exemplary double-throw switch of FIG. 1.
Figure 8:
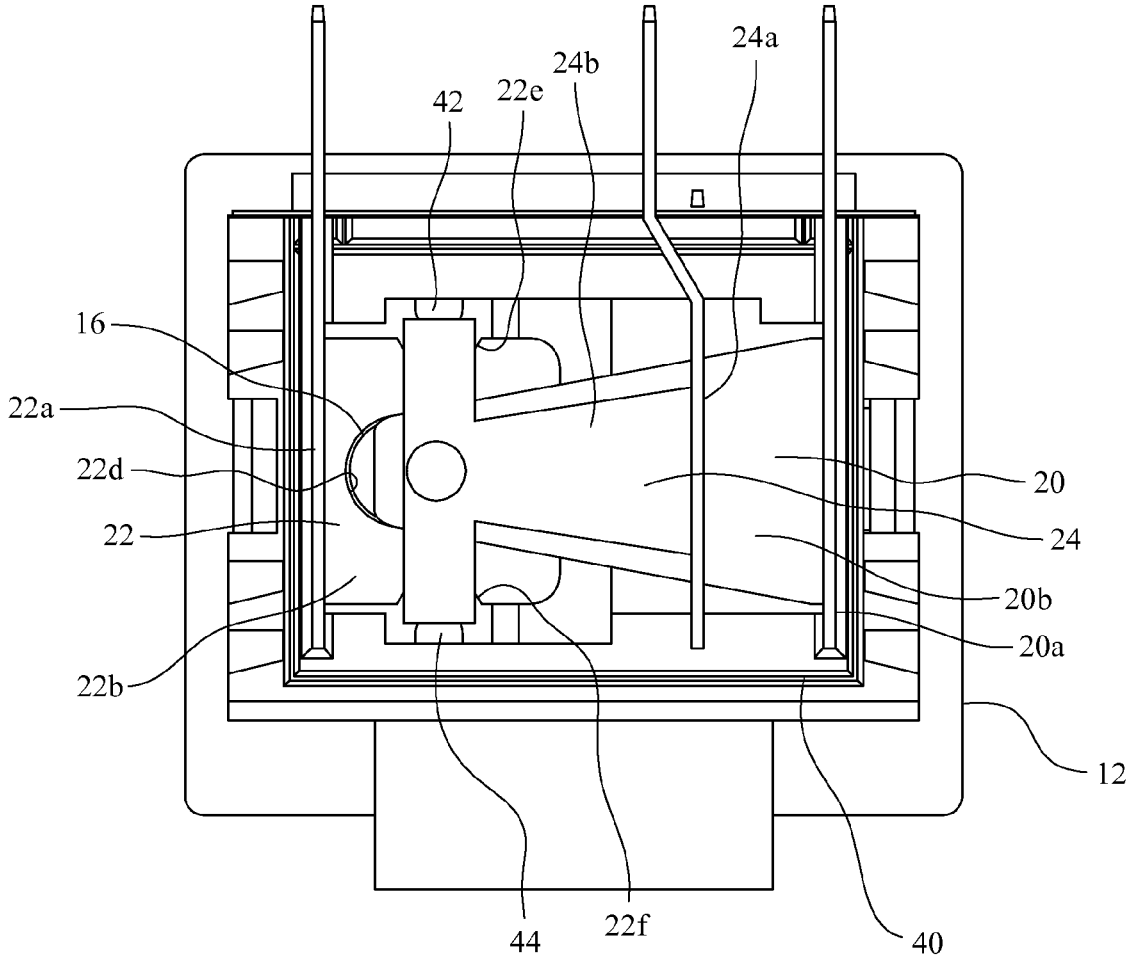
FIG. 8 is a bottom view of the exemplary double-throw switch of FIG. 1, but with the cover removed to better show the first stationary terminal, the second stationary terminal, and the moveable terminal.

In this exemplary embodiment, the first stationary terminal 22 is also a unitary component made from a conductive material, such as copper. The first stationary terminal 22 can also be characterized as including a first portion 22*a* that is rigidly secured within the internal cavity defined by the housing 12 and serves as a blade connector, along with a second portion 22*b* that extends from the first portion 22*a*. Similar to the moveable terminal 20, in this exemplary embodiment, and as best shown in FIGS. 4 and 5, the first stationary terminal 22 also includes an enlarged contact portion 22*c* on the bottom surface of the second portion 22*b* which is configured to contact the first contact portion 20*c* of the moveable terminal 20 when the first circuit is closed (as shown in FIG. 4). Furthermore, an opening 22*d* is defined through the second portion 22*b* of the first stationary terminal 22, as perhaps best shown in the bottom view of FIG. 8, which allows the internal post member 16 to move downward and through the first stationary terminal 22, so that the internal post member 16 can engage and apply pressure to the moveable terminal 20, but without contacting the first stationary terminal 22. Finally, in this exemplary embodiment, and as shown in FIGS. 2 and 8, cutouts 22*e*, 22*f* are defined along opposite edges of the second portion 22*b* of the first stationary terminal 22, the importance of which is further described below.

In this exemplary embodiment, the second stationary terminal 24 is also a unitary component made from a conductive material, such as copper. The second stationary terminal 24 can also be characterized as including a first portion 24*a* that is rigidly secured in the housing 12 and serves as a blade connector, along with a second portion 24*b* that extends from the first portion 24*a*. Furthermore, similar to the moveable terminal 20 and the first stationary terminal 22, in this exemplary embodiment, and as best shown in FIGS. 4 and 5, the second stationary terminal 24 includes an enlarged contact portion 24*c* on the upper surface of the second portion 24*b* which is configured to contact the second contact portion 20*d* of the moveable terminal 20 when the second circuit is closed (as shown in FIG. 5). Finally, in this exemplary embodiment, and as best shown in FIG. 8, the second portion 24*b* of the second stationary terminal 24 is T-shaped, the importance of which is further described below.

Referring once again to the sectional views of FIGS. 4 and 5, when the distal end of the internal post member 16 applies pressure to the moveable terminal 20, it causes the moveable terminal 20 to break contact with the first stationary terminal 22, thus opening the first circuit. As the internal post member 16 applies further pressure to the moveable terminal 20, it causes the moveable terminal 20 to then make contact with the second stationary terminal 24, thus closing the second circuit (as shown in FIG. 5). In this regard, the exemplary double-throw switch 10 acts as a break-before-make switch, where only one of the first and second circuits is closed at any given time; however, it is contemplated that the switch could be configured such that it acts as a make-before-break switch without departing from the spirit and scope of the present invention.

Once the force is no longer applied to the push button 14, the push button 14 returns to the extended position, and the moveable terminal 20 breaks contact with the second stationary terminal 24, thus opening the second circuit, and then again makes contact with the first stationary terminal 22, thus closing the first circuit. In this regard, the moveable terminal 20 has sufficient resilience that it also functions like a leaf spring, providing a biasing force against the internal post member 16 that returns the push button 14 to the extended position.

Figure 7:
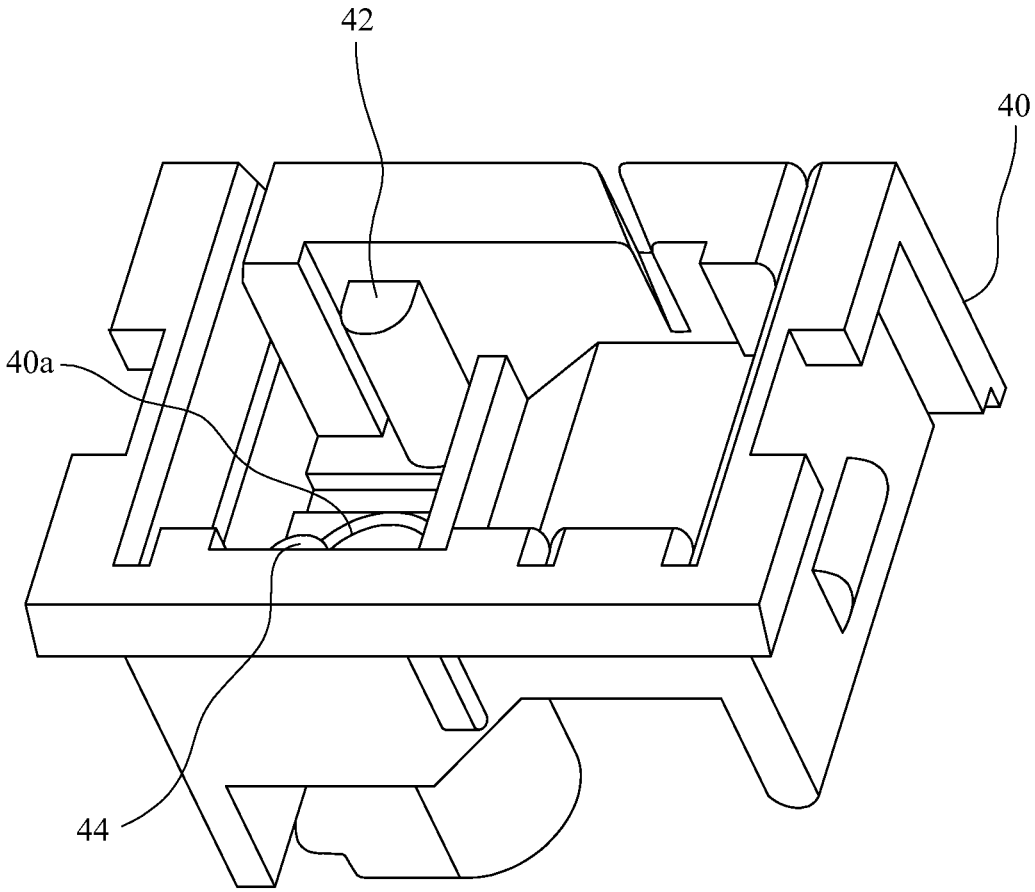
FIG. 7 is a bottom perspective view of the base of the exemplary double-throw switch of FIG. 1.

Referring now to FIGS. 4, 5, and 7, as mentioned above, the exemplary double-throw switch 10 also includes a base 40 that is located within the housing 12. The push button 14 rotates toward and away from this base 40 about the pivot axis A, and the internal post member 16 passes through a channel 40*a* defined by the base 40. An upper pair of positive stops 42, 44 extends from an interior surface of this base 40 (as perhaps best shown in FIG. 7), with each of the upper positive stops 42, 44 engaging the second portion 24*b* of the second stationary terminal 24 at a predetermined position in the movement of the second stationary terminal 24.

Furthermore, and referring now to FIGS. 4-6 and 8, the cover 30 of the exemplary double-throw switch 10 closes access to the internal cavity defined by the housing 12 of the switch 10 near the terminals 20, 22, 24. A lower pair of positive stops 32, 34 extends from the surface of the cover 30, with each of the lower positive stops 32, 34 engaging the second portion 22*b* of the first stationary terminal 22 at a predetermined position in the movement of the first stationary terminal 22. However, the lower positive stops 32, 34 have no effect on the movement of the moveable terminal 20. In this regard, the second portion 20*b* of the moveable terminal 20 preferably has a tapered (triangular) shape, such that it can move relative to and between the lower positive stops 32, 34 without contacting the lower positive stops 32, 34. Accordingly, in use, the lower positive stops 32, 34 apply pressure to and maintain the position of the first stationary terminal 22, but do not interfere with or impede the moveable terminal 20. Additionally, as best shown in FIG. 8, the second portion 24*b* of the second stationary terminal 24 preferably has a T-shape with a narrow central portion and a wide distal end, such that the lower positive stops 32, 34 pass on either side of the narrow central portion without contacting the second stationary terminal 24.

Furthermore, in this exemplary embodiment, and as shown in FIGS. 4-5 and 7-8, the upper positive stops 42, 44 extend from the internal sides of the base 40 and have no effect on the movement of the moveable terminal 20. In this regard, as best shown in FIG. 8, the preferably tapered (triangular) shape of the second portion 20*b* of the moveable terminal 20 also allows it to move relative to and between the upper positive stops 42, 44 without contacting the upper positive stops 42, 44. Additionally, the wide distal end of the T-shaped second portion 24*b* of the second stationary terminal 24 is wider than the distal end of the second portion 20*b* of the moveable terminal 20. Accordingly, in use, the upper positive stops 42, 44 also apply pressure to and maintain the position of the second stationary terminal 24, but do not interfere with or impede the moveable terminal 20.

With respect to the upper positive stops 42, 44, and as best shown in FIG. 8, it should also be noted that the cutouts 22*e*, 22*f* defined along opposite edges of the second portion 22*b* of the first stationary terminal 22 are vertically aligned with each outer edge of the wide distal end of the T-shaped second portion 24*b* of the second stationary terminal 24. Furthermore, the cutouts 22*e*, 22*f* are sized to accommodate the upper positive stops 42, 44, such that the upper positive stops 42, 44 pass on either side of the second portion 22*b* of the first stationary terminal 22, around the second portion 20*b* of the moveable terminal 20, where they contact each outer edge of the wide distal end of the T-shaped second portion 24*b* of the second stationary terminal 24.

When the internal post member 16 moves downward and applies pressure to the moveable terminal 20, the lower positive stops 32, 34 (or first set of positive stops) prevent any further movement of the first stationary terminal 22 with the moveable terminal 20, at least beyond a predetermined position, thus breaking the first circuit. In other words, the lower positive stops 32, 34 substantially eliminate any resistance to the disengagement of the moveable terminal 20 from the first stationary terminal 22.

When the internal post member 16 moves further downward and applies more pressure to the moveable terminal 20, the moveable terminal 20 then makes contact with the second stationary terminal 24, thus closing the second circuit. When the internal post member 16 is released, and the moveable terminal 20 begins to move upward, the upper positive stops 42, 44 (or second set of positive stops) prevent any further movement of the second stationary terminal 24 with the moveable terminal 20, at least beyond a predetermined position, thus breaking the second circuit. In other words, the upper positive stops 42, 44 substantially eliminate any resistance to the disengagement of the moveable terminal 20 from the second stationary terminal 24. And, as a result, the double-throw circuit opens and closes the first and second circuits more consistently.

One of ordinary skill in the art will also recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A double-throw switch, comprising:

a housing that defines an internal cavity;

a push button that is mounted for movement with respect to the housing;

a first stationary terminal, including a first portion that is rigidly secured in the housing and serves as a blade connector, along with a second portion that extends from the first portion;

a second stationary terminal;

a moveable terminal that, when in contact with the first stationary terminal, closes a first circuit, and when in contact with the second stationary terminal, closes a second circuit;

a first set of one or more positive stops that engages the second portion of the first stationary terminal; and a second set of one or more positive stops that engages the second stationary terminal;

wherein, when a force is applied to the push button, (a) the moveable terminal breaks contact with the first stationary terminal, thus opening the first circuit, and (b) the moveable terminal makes contact with the second stationary terminal, thus closing the second circuit;

wherein, the first set of one or more positive stops applies pressure to and maintains a predetermined position of the second portion of the first stationary terminal, but does not interfere with or impede the moveable terminal;

wherein, the second set of one or more positive stops applies pressure to and maintains a predetermined position of the second stationary terminal, but does not interfere with or impede the moveable terminal; and wherein the second portion of the first stationary terminal defines a first cutout on one edge of the second portion of the first stationary terminal and a second cutout on an opposite edge of the second portion of the first stationary terminal, such that a respective positive stop of the second set passes through each of the first and second cutouts on either side of the second portion of the first stationary terminal without contacting the first stationary terminal.

2. A double-throw switch, comprising:

a housing that defines an internal cavity;

a push button that is mounted for movement with respect to the housing;

a first stationary terminal;

a second stationary terminal;

a moveable terminal that, when in contact with the first stationary terminal, closes a first circuit, and when in contact with the second stationary terminal, closes a second circuit;

an internal post member that extends between the push button and the moveable terminal, wherein an opening is defined by the first stationary terminal, and the internal post member passes through the opening defined by the first stationary terminal to engage the moveable terminal;

a first set of one or more positive stops that engages the first stationary terminal; and a second set of one or more positive stops that engages the second stationary terminal;

wherein, when a force is applied to the push button, the push button rotates and forces the internal post member to move downward and apply pressure to the moveable terminal, causing (a) the moveable terminal to break contact with the first stationary terminal, thus opening the first circuit, and (b) the moveable terminal to make contact with the second stationary terminal, thus closing the second circuit;

wherein, the first set of one or more positive stops applies pressure to and maintains a predetermined position of the first stationary terminal, but does not interfere with or impede the moveable terminal; and wherein, the second set of one or more positive stops applies pressure to and maintains a predetermined position of the second stationary terminal, but does not interfere with or impede the moveable terminal.

3. A double-throw switch, comprising:

a housing that defines an internal cavity;

a push button that is mounted for movement with respect to the housing;

a first stationary terminal;

a second stationary terminal, including a first portion that is rigidly secured in the housing and serves as a blade connector, along with a second portion that extends from the first portion;

a moveable terminal that, when in contact with the first stationary terminal, closes a first circuit, and when in contact with the second stationary terminal, closes a second circuit;

a first set of one or more positive stops that engages the first stationary terminal; and a second set of one or more positive stops that engages the second portion of the second stationary terminal;

wherein, when a force is applied to the push button, (a) the moveable terminal breaks contact with the first stationary terminal, thus opening the first circuit, and (b) the moveable terminal makes contact with the second stationary terminal, thus closing the second circuit;

wherein, the first set of one or more positive stops applies pressure to and maintains a predetermined position of the first stationary terminal, but does not interfere with or impede the moveable terminal;

wherein, the second set of one or more positive stops applies pressure to and maintains a predetermined position of the second portion of the second stationary terminal, but does not interfere with or impede the moveable terminal; and wherein the second portion of the second stationary terminal has a T-shape with a narrow central portion and a wide distal end, such that a respective positive stop of the first set passes on either side of the narrow central portion without contacting the second stationary terminal.

4. The double-throw switch as recited in claim 3, wherein the first stationary terminal includes a first portion that is rigidly secured in the housing and serves as a blade connector, along with a second portion that extends from the first portion; and wherein the second portion of the first stationary terminal defines a first cutout on one edge of the second portion of the first stationary terminal and a second cutout on an opposite edge of the second portion of the first stationary terminal, such that a respective positive stop of the second set passes through each of the first and second cutouts on either side of the second portion of the first stationary terminal without contacting the first stationary terminal.

5. The double-throw switch as recited in claim 4, wherein the first cutout on the second portion of the first stationary terminal is vertically aligned with one outer edge of the wide distal end of the second portion of the second stationary terminal and the second cutout on the second portion of the first stationary terminal is vertically aligned with an opposite outer edge of the wide distal end of the second portion of the second stationary terminal, such that a respective positive stop of the second set passes through each of the first and second cutouts on either side of the second portion of the first stationary terminal without contacting the first stationary terminal to engage the wide distal end of the second portion of the second stationary terminal.

6. A double-throw switch, comprising:

a housing that defines an internal cavity;

a push button that is mounted for movement with respect to the housing;

a first stationary terminal;

a second stationary terminal;

a moveable terminal that includes a first portion that is rigidly secured in the housing and a second portion that extends from the first portion in a cantilever arrangement, wherein, when a distal end of the second portion of the moveable terminal is in contact with the first stationary terminal, the moveable terminal closes a first circuit, and when the distal end of the second portion of the moveable terminal is in contact with the second stationary terminal, the moveable terminal closes a second circuit;

a first set of one or more positive stops that engages the first stationary terminal; and a second set of one or more positive stops that engages the second stationary terminal;

wherein, when a force is applied to the push button, the distal end of the second portion of the movement terminal deflects and moves in a first direction, such that (a) the moveable terminal breaks contact with the first stationary terminal, thus opening the first circuit, and (b) the moveable terminal makes contact with the second stationary terminal, thus closing the second circuit;

wherein, the first set of one or more positive stops applies pressure to and resists movement of the first stationary terminal in the first direction, and thus maintains a predetermined position of the first stationary terminal, but does not interfere with or impede the moveable terminal; and wherein, the second set of one or more positive stops applies pressure to and resists movement of the second stationary terminal in a second direction opposite to the first direction, and thus maintains a predetermined position of the second stationary terminal, but does not interfere with or impede the moveable terminal.

7. The double-throw switch as recited in claim 6, wherein the first portion of the moveable terminal serves as a blade connector.

8. The double-throw switch as recited in claim 6, wherein at least one positive stop of the first set of one or more positive stops is positioned on one side of the moveable terminal, and at least one positive stop of the first set of one or more positive stops is positioned on an opposite side of the moveable terminal.

9. The double-throw switch as recited in claim 6, and further comprising a base located within the internal cavity defined by the housing, wherein the second set of one or more positive stops extends from the base to engage the second stationary terminal.

10. The double-throw switch as recited in claim 9, wherein at least one positive stop of the second set of positive stops extends from the base on one side of the moveable terminal, and at least one positive stop of the second set of positive stops extends from the base on an opposite side of the moveable terminal.

11. The double-throw switch as recited in claim 6, and further comprising an internal post member that extends between the push button and the moveable terminal, wherein, when the force is applied to the push button, the push button rotates and forces the internal post member to move downward and apply pressure to the moveable terminal, causing (a) the moveable terminal to break contact with the first stationary terminal, thus opening the first circuit, and (b) the moveable terminal to make contact with the second stationary terminal, thus closing the second circuit.

12. The double-throw switch as recited in claim 11, wherein the moveable terminal has sufficient resilience to provide a biasing force against the internal post member that returns the push button to an extended position.

13. The double-throw switch as recited in claim 11, wherein an opening is defined by the first stationary terminal, and the internal post member passes through the opening defined by the first stationary terminal to engage the moveable terminal.

14. The double-throw switch as recited in claim 6, and further comprising a cover that closes access to the internal cavity defined by the housing.

15. The double-throw switch as recited in claim 14, wherein the first set of one or more positive stops extends from the cover to engage the first stationary terminal.

16. The double-throw switch as recited in claim 14, wherein at least one positive stop of the first set of positive stops extends from the cover on one side of the moveable terminal, and at least one positive stop of the first set of positive stops extends from the cover on an opposite side of the moveable terminal.

17. The double-throw switch as recited in claim 16, and further comprising a base located within the internal cavity defined by the housing, wherein at least one positive stop of the second set of positive stops extends from the base on one side of the moveable terminal to engage the second stationary terminal, and at least one positive stop of the second set of positive stops extends from the base on an opposite side of the moveable terminal.

18. The double-throw switch as recited in claim 17, wherein the first portion of the moveable terminal serves as a blade connector, and wherein the second portion of the moveable terminal has a tapered shape, such that it can move relative to and between both the first set of one or more positive stops and the second set of one or more positive stops without contacting either the first set of one or more positive stops or the second set of one or more positive stops.

* * * * *